US007717235B2

(12) United States Patent
Marshall et al.

(10) Patent No.: US 7,717,235 B2
(45) Date of Patent: May 18, 2010

(54) CONVERTIBLE POINT-OF-SALE CHECKOUT TERMINAL

(75) Inventors: Graham Marshall, Shoreham, NY (US); Shane MacGregor, Forest Hills, NY (US); Alistair Hamilton, Sammamish, WA (US)

(73) Assignee: Symbol Technologies, Inc., Holtsville, NY (US)

( * ) Notice: Subject to any disclaimer, the term of this patent is extended or adjusted under 35 U.S.C. 154(b) by 1 day.

(21) Appl. No.: 12/229,582

(22) Filed: Aug. 25, 2008

(65) Prior Publication Data

US 2010/0044157 A1 Feb. 25, 2010

(51) Int. Cl.
*A47F 9/04* (2006.01)

(52) U.S. Cl. ..... 186/61

(58) Field of Classification Search ..... 186/59, 186/61

See application file for complete search history.

(56) References Cited

U.S. PATENT DOCUMENTS

| | | | | |
|---|---|---|---|---|
| 5,019,694 | A * | 5/1991 | Collins, Jr. | 235/383 |
| 5,177,345 | A * | 1/1993 | Baitz | 186/61 |
| 2002/0126110 | A1 * | 9/2002 | Bowron | 345/204 |
| 2009/0032588 | A1 * | 2/2009 | Hassenzahl | 235/383 |

* cited by examiner

*Primary Examiner*—Patrick Mackey
*Assistant Examiner*—Mark Beauchaine

(57) ABSTRACT

A convertible checkout terminal includes a housing having a window and a data capture device for capturing through the window data associated with products to be checked out at the terminal, a customer interface supported by the housing for enabling a customer to interact with the terminal in a self-service mode of operation, a clerk interface supported by the housing for enabling a clerk to interact with the terminal in a full-service mode of operation, and a mode selector for selecting either the self-service mode in which the customer interface is operational, or the full-service mode in which the clerk interface is operational.

20 Claims, 6 Drawing Sheets

-PRIOR ART-

-PRIOR ART-

CONVERTIBLE POINT-OF-SALE CHECKOUT TERMINAL

BACKGROUND OF THE INVENTION

In the retail industry, flat bed laser readers, also known as horizontal slot scanners, have been used to electro-optically read one-dimensional bar code symbols, particularly of the Universal Product Code (UPC) type, at full-service, point-of-transaction checkout terminals operated by checkout clerks in supermarkets, warehouse clubs, department stores, and other kinds of retailers for many years. As exemplified by U.S. Pat. No. 5,059,779; No. 5,124,539 and No. 5,200,599, a single, horizontal window is set flush with, and built into, a horizontal countertop of the terminal. Products to be purchased bear identifying symbols and are typically slid across the horizontal window through which a multitude of scan lines is projected in a generally upwards direction. When at least one of the scan lines sweeps over a symbol associated with a product, the symbol is processed and read. The multitude of scan lines is typically generated by a scan pattern generator which includes a laser for emitting a laser beam at a mirrored component mounted on a shaft for rotation by a motor about an axis. A plurality of stationary mirrors is arranged about the axis. As the mirrored component turns, the laser beam is successively reflected onto the stationary mirrors for reflection therefrom through the horizontal window as a scan pattern of the scan lines.

It is also known to provide a checkout terminal not only with a generally horizontal window, but also with an upright or generally vertical window that faces the clerk at the terminal. The generally vertical window is oriented generally perpendicularly to the horizontal window, or is slightly rearwardly or forwardly inclined. The laser scan pattern generator within this dual window or bioptical terminal also projects the multitude of scan lines in a generally outward direction through the vertical window toward the clerk. The generator for the vertical window can be the same as or different from the generator for the horizontal window. The clerk slides the products past either window, e.g., from right to left, or from left to right, in a "swipe" mode. Alternatively, the clerk merely presents the symbol on the product to a central region of either window in a "presentation" mode. The choice depends on clerk preference or on the layout of the terminal.

Sometimes, the vertical window is not built into the terminal as a permanent installation. Instead, a vertical slot scanner is configured as a portable reader that is placed on the countertop of an existing horizontal slot scanner in a hands-free mode of operation. In the frequent event that large, heavy, or bulky products, that cannot easily be brought to the reader, have symbols that are required to be read, then the clerk may also manually grasp the portable reader and lift it off, and remove it from, the countertop for reading the symbols in a handheld mode of operation.

As advantageous as these laser-based, point-of-transaction terminals are in processing transactions involving products associated with one-dimensional symbols, each having a row of bars and spaces spaced apart along one direction, these terminals cannot process stacked symbols, such as Code 49 that introduced the concept of vertically stacking a plurality of rows of bar and space patterns in a single symbol, as described in U.S. Pat. No. 4,794,239, or two-dimensional symbols, such as PDF417 that increased the amount of data that could be represented or stored on a given amount of surface area, as described in U.S. Pat. No. 5,304,786. Both one- and two-dimensional symbols, as well as stacked symbols, can be read by employing imaging readers each having a solid-state imager which has a one- or two-dimensional array of cells or photosensors that correspond to image elements or pixels in a field of view of the imager. Such an imager may include a one- or two-dimensional charge coupled device (CCD) or a complementary metal oxide semiconductor (CMOS) device, as well as associated circuits for producing electronic signals corresponding to the one- or two-dimensional array of pixel information over the field of view.

It is therefore known to use a solid-state imager for capturing a monochrome image of a symbol as, for example, disclosed in U.S. Pat. No. 5,703,349. It is also known to use a solid-state imager with multiple buried channels for capturing a full color image of a target as, for example, disclosed in U.S. Pat. No. 4,613,895. It is common to provide a two-dimensional CCD with a 640×480 resolution commonly found in VGA monitors, although other resolution sizes are possible.

It is also known to install the solid-state imager, analogous to that conventionally used in a consumer digital camera, in a bioptical, point-of-transaction terminal, as disclosed in U.S. Pat. No. 7,191,947 in which the dual use of both the solid-state imager and the laser scan pattern generator in the same terminal is disclosed. It is possible to replace all of the laser scan pattern generators with solid-state imagers in order to improve reliability and to enable the reading of two-dimensional and stacked symbols, as well as other targets.

All of the above-described terminals are typically operated by checkout clerks. In an effort to reduce, if not eliminate, the need for checkout clerks and their associated labor cost, a number of self-service, point-of-sale, checkout terminals have been proposed. A self-service checkout terminal is operated by the customer without the aid of the checkout clerk. During operation of the self-service checkout terminal, the customer moves individual products for purchase across a window of the terminal to read their respective symbols, and then places the read products into a carry-out bag, if desired. The customer then pays for his or her purchases either at the self-service checkout terminal if so equipped with a credit/debit card reader, or at a central payment area that is staffed by a store employee. Thus, the self-service checkout terminal permits the customer to select, itemize, and, in some cases, pay for his or her purchases, without the assistance of the retailer's personnel.

However, the known self-service checkout terminals are relatively expensive to install and are sometimes difficult for some customers to operate, thereby potentially causing such terminals to go unused or underutilized, and their expense to be economically unjustified. Some retailers expect their clerks to stand nearby self-service terminals to be rapidly called in for assistance when necessary. Some self-service terminals require that certain equipment be moved into position depending on whether the customer or the clerk is handling the transaction. Dedicated self-service terminals occupy valuable real estate in a retailer's operation, which might otherwise be used for full-service terminals. Full-service terminals are not readily convertible into self-service terminals.

SUMMARY OF THE INVENTION

One feature of this invention resides, briefly stated, in a convertible checkout terminal for, and a method of, converting the checkout terminal between a self-service mode and a full-service mode of operation. A convertible checkout terminal is a system or workstation that can be operated in a self-service mode in which a customer operates the terminal without the assistance of store personnel, but can also be transformed or converted in order to be operated in an assisted or full-service mode in which the terminal is operated by a checkout clerk or the like. Such convertible terminals have the advantage in that the operation of the terminal may be altered to fit the immediate needs of the retailer's operation.

In accordance with one aspect of this invention, the terminal includes a housing having a window and a data capture device for capturing through the window data associated with products to be checked out at the terminal. A customer interface is supported by the housing, and is operative for enabling a customer to interact with the terminal in the self-service mode of operation. A clerk interface is also supported by the housing, and is operative for enabling a clerk to interact with the terminal in the full-service mode of operation. A mode selector is operative for selecting either the self-service mode in which the customer interface is operational, or the full-service mode in which the clerk interface is operational. The terminal of this invention is relatively inexpensive to install, and the interfaces are simple to operate, thereby maximizing their utilization. The terminal is readily and rapidly convertible between full-service and self-service.

In a preferred embodiment, the housing is supported by a support surface, such as a countertop formed with a recess, and the housing has a base portion received in the recess. The window is located in a generally horizontal plane, and the housing has another window located in a generally upright plane that intersects the generally horizontal plane, thereby comprising a bioptical workstation. The housing has a pair of opposite end regions and a central region between the end regions. The central region lies in the generally horizontal plane, and the end regions have tilted portions that lie in inclined planes that intersect the horizontal plane. Preferably, the window is located in the central region, and the housing has a pair of side windows located in the end regions and mutually facing each other.

In a preferred embodiment, the data are indicia, typically one- or two-dimensional bar code symbols, on the products, and the data capture device includes an electro-optical reader for electro-optically reading the indicia. The reader is advantageously an imaging reader that operates by image capture, and includes a plurality of solid-state imagers for capturing light from the indicia through the windows along different fields of view. Each imager preferably comprises a two-dimensional, charge coupled device (CCD) array or a complementary metal oxide semiconductor (CMOS) array of sub-megapixel size, e.g., 752 pixels wide×480 pixels high, in order to reduce the costs of the imagers, as compared to supermegapixel arrays. Each imager includes an illuminator for illuminating the indicia with illumination light from illumination light sources, e.g., light emitting diodes (LEDs). A controller is operative for controlling each illuminator to illuminate the indicia, for controlling each imager to capture the illumination light returning from the indicia over an exposure time period to produce electrical signals indicative of the indicia being read, and for processing the electrical signals to read the indicia. Each illuminator is only operative during the exposure time period. Each imager is controlled to capture the light from the indicia during different exposure time periods to avoid mutual interference among the illuminators.

In accordance with another aspect of this invention, the customer interface has a first interactive screen, e.g., a display and/or touch screen, located at one of the end regions, and the clerk interface has a second interactive screen, e.g., another display and/or touch screen, located at the other of the end regions. A receipt printer is located at either end region, and a keypad is also located at either end region. The second interactive screen is mounted at the other end region for movement, e.g., pivoting movement, between a raised position in which the second interactive screen faces and interacts with the customer, and a lowered position in which the second interactive screen faces and interacts with the clerk. The mode selector is an actuatable switch, e.g., a pressure, magnetic, or optical switch, actuated by the second interactive screen when moved between the raised and lowered positions. A controller is operatively connected to the switch, for controlling operation of the self-service mode in the raised position, and for controlling operation of the full-service mode in the lowered position. Thus, by simply moving the second interactive screen, the terminal is rapidly and easily converted.

In accordance with another feature of this invention, the method of converting the terminal is performed by configuring a housing with a window and a data capture device for capturing through the window data associated with products to be checked out at the terminal, enabling a customer to interact with the terminal in a self-service mode of operation with a customer interface supported by the housing, enabling a clerk to interact with the terminal in a full-service mode of operation with a clerk interface supported by the housing, and selecting either the self-service mode in which the customer interface is operational, or the full-service mode in which the clerk interface is operational.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
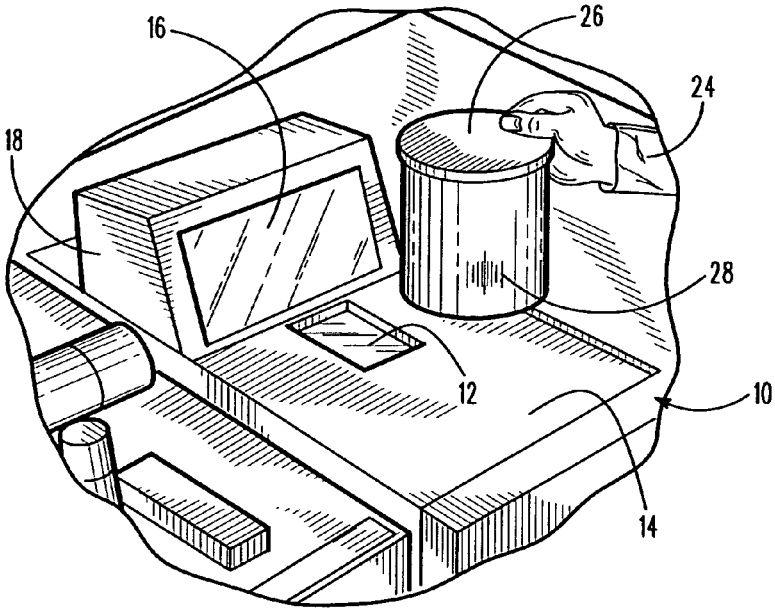
FIG. 1 is a perspective view of a dual window, bioptical, point-of-transaction workstation or terminal operative for reading indicia in accordance with the prior art.

FIG. 1 depicts a dual window, bioptical, point-of-transaction workstation 10 used in the prior art by retailers to process transactions involving the purchase of products bearing an identifying target, such as the UPC symbol described above. Workstation 10 has a generally horizontal window 12 set flush with, or recessed into, a countertop 14, and a vertical or generally vertical (referred to as "vertical" or "upright" hereinafter) window 16 set flush with, or recessed into, a raised housing portion 18 above the countertop 14.

Figure 2:
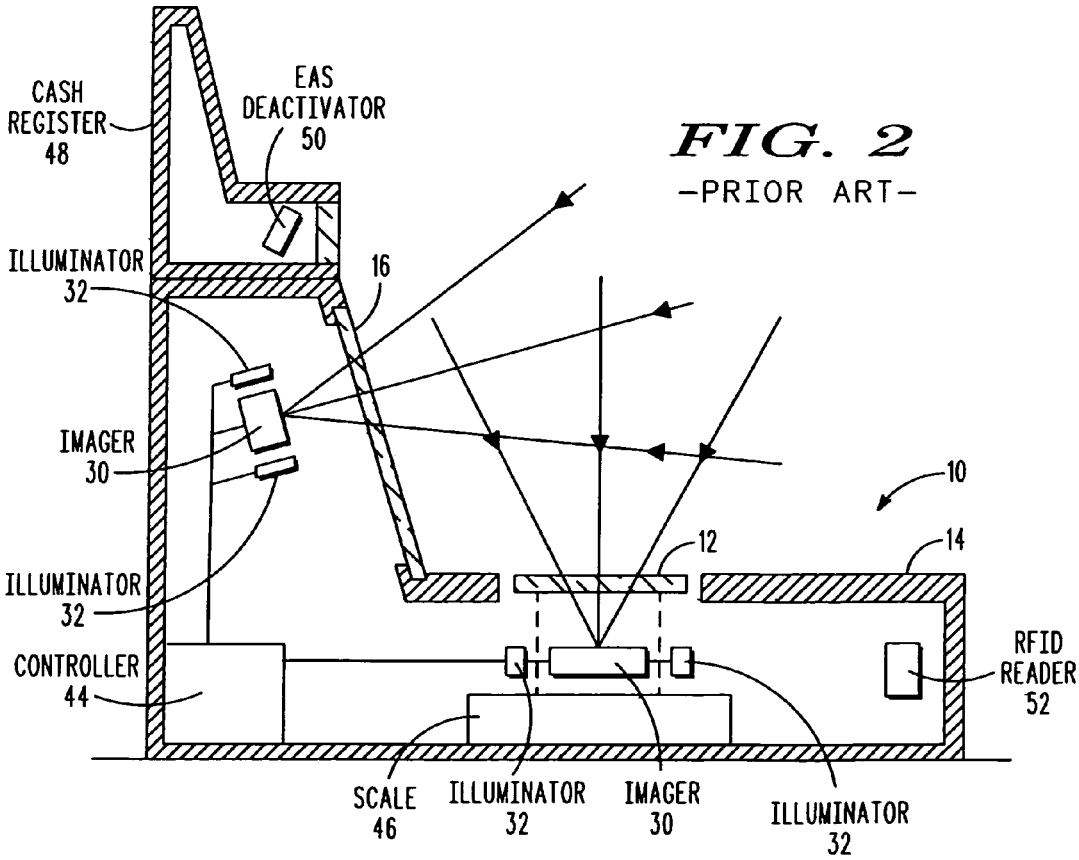
FIG. 2 is a part-sectional, part-diagrammatic, schematic view of a terminal analogous to that shown in FIG. 1 in accordance with the prior art.
Figure 3:
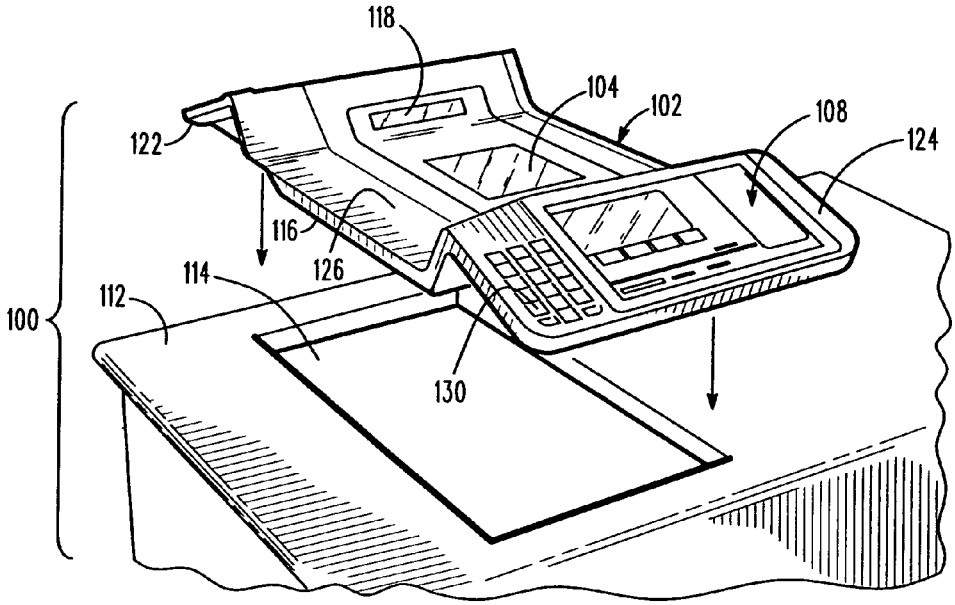
FIG. 3 is a perspective, exploded view of a stationary embodiment of a convertible, point-of-transaction, checkout terminal operative for reading indicia on products in accordance with this invention.

As schematically shown in FIG. 2, a plurality of imaging readers, each including a solid-state imager 30 and an illuminator 32, are also mounted at the workstation in accordance with the prior art, for capturing light passing through either or both windows 12, 16 from a target that can be a one- or two-dimensional symbol, such as a two-dimensional symbol on a driver's license, or any document. Each imager 30 is a solid-state area array, preferably a CCD or CMOS array, of submegapixel size. Each imager 30 preferably has a global shutter. Each illuminator 32 is preferably one or more light sources, e.g., surface-mounted, light emitting diodes (LEDs), located at each imager 30 to uniformly illuminate the target.

In use, an operator 24, such as a clerk working at a supermarket checkout counter, processes a product 26 bearing a UPC symbol 28 thereon, past the windows 12, 16 by swiping the product across a respective window, or by presenting the product by holding it momentarily steady at the respective window. The symbol 28 may located on any of the top, bottom, right, left, front and rear, sides of the product, and at least one, if not more, of the imagers 30 will capture the illumination light reflected, scattered, or otherwise returning from the symbol through one or both windows.

FIG. 2 also schematically depicts that a weighing scale 46, a cash register 48, and an electronic article surveillance (EAS) deactivator 50 may be mounted at the workstation. The generally horizontal window 12 advantageously serves not only as a weighing platter for supporting a product to be weighed, but also allows the return light to pass therethrough. The register 48 can sit atop the raised housing portion 18, or be integrated therewith. A radio frequency identification (RFID) reader 52 may also advantageously be mounted at the workstation. The reader 52 can be mounted at any location and not only below the countertop 14, as shown.

As also schematically shown in FIG. 2, the imagers 30 and their associated illuminators 32 are operatively connected to a programmed microprocessor or controller 44 operative for controlling the operation of these and other components. Preferably, the microprocessor is the same as the one used for decoding the return light scattered from the target and for processing the captured target images.

In operation, the microprocessor 44 sends successive command signals to the illuminators 32 to pulse the LEDs for a short time period of 300 microseconds or less, and successively energizes the imagers 30 to collect light from a target only during said time period, also known as the exposure time period. By acquiring a target image during this brief time period, the image of the target is not excessively blurred even in the presence of relative motion between the imagers and the target.

The energization of the imagers 30 can be manual and initiated by the operator. For example, the operator can depress a button, or a foot pedal, at the workstation. The energization can also be automatic such that the imagers operate in a continuous image acquisition mode, which is the desired mode for video surveillance of the operator, as well as for decoding two-dimensional symbols. In the preferred embodiment, all the imagers will be continuously sequentially energized for scanning symbols until such time as there has been a period of inactivity that exceeds a pre-programmed time interval. For example, if no symbols have been scanned for ten minutes, then after this time period has elapsed, the reader enters a power-savings mode in which one or more of the imagers will be omitted from sequential energization. Alternatively, illumination levels may be reduced or turned off. At least one imager will remain active for periodically capturing images. If the active imager detects anything changing within its field of view, this will indicate to the operator that a product bearing a symbol is moving into the field of view, and illumination and image capture will resume to provide high performance scanning.

Figure 4:
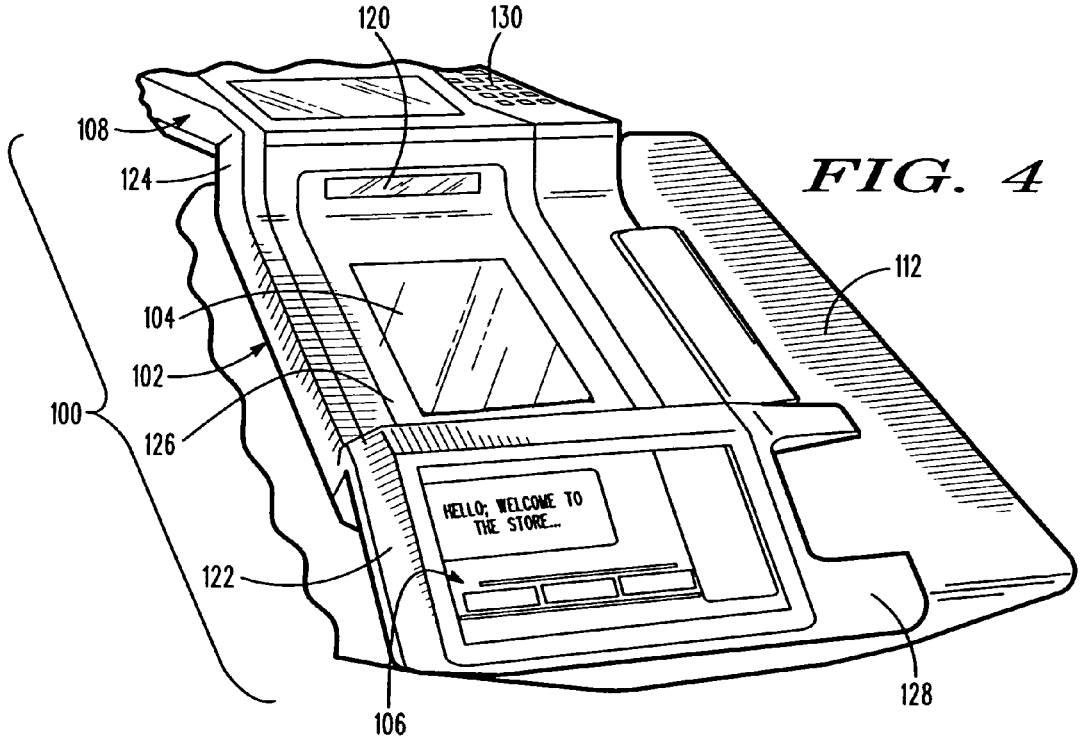
FIG. 4 is a perspective view of the terminal of FIG. 3 in the full-service mode of operation.
Figure 5:
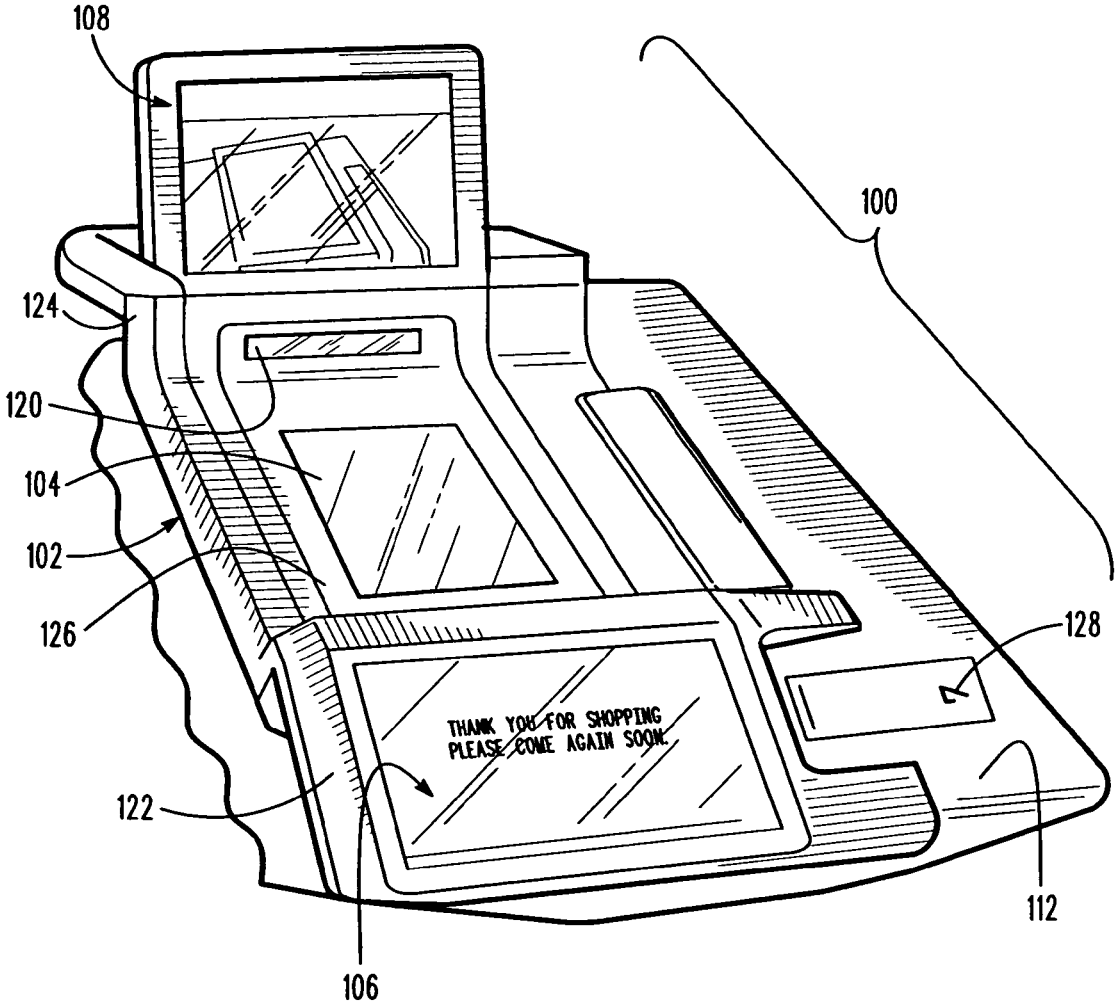
FIG. 5 is a perspective view of the terminal of FIG. 3 in the self-service mode of operation.
Figure 6:
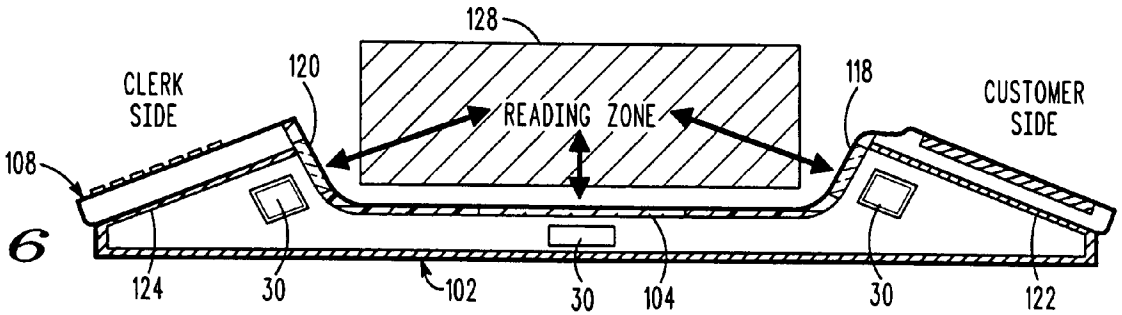
FIG. 6 is a part-sectional, part-diagrammatic, view of the terminal of FIG. 3.
Figure 7:
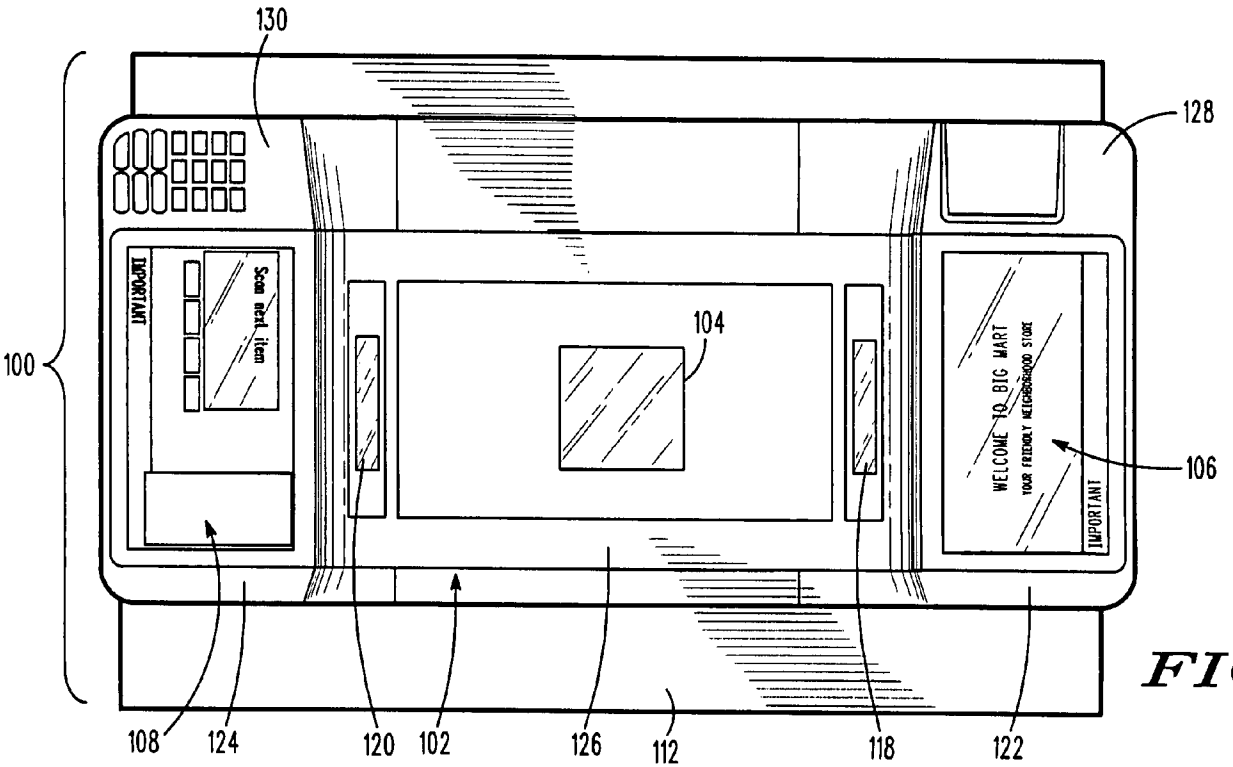
FIG. 7 is a top plan view of the terminal of FIG. 3.
Figure 8:
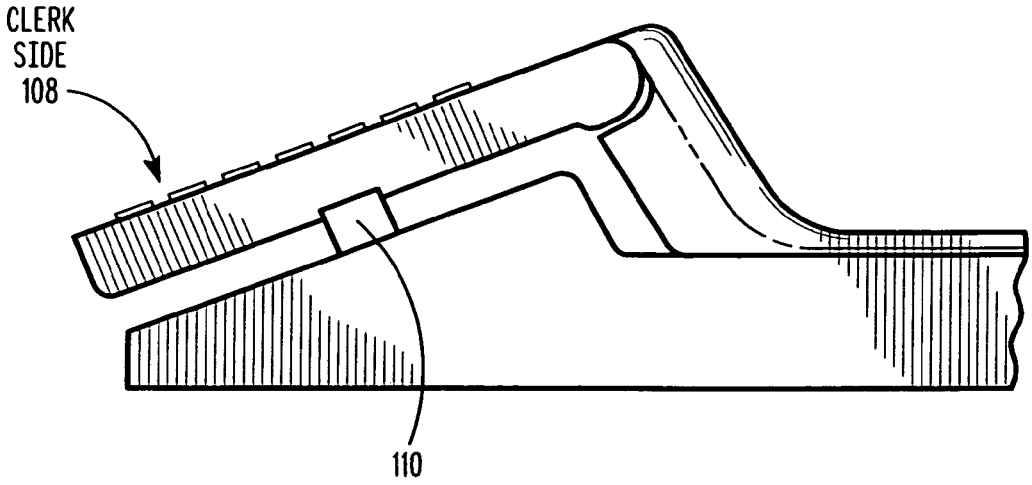
FIG. 8 is a broken-away, side view of a detail of the terminal of FIG. 3 in the full-service mode of operation.
Figure 9:
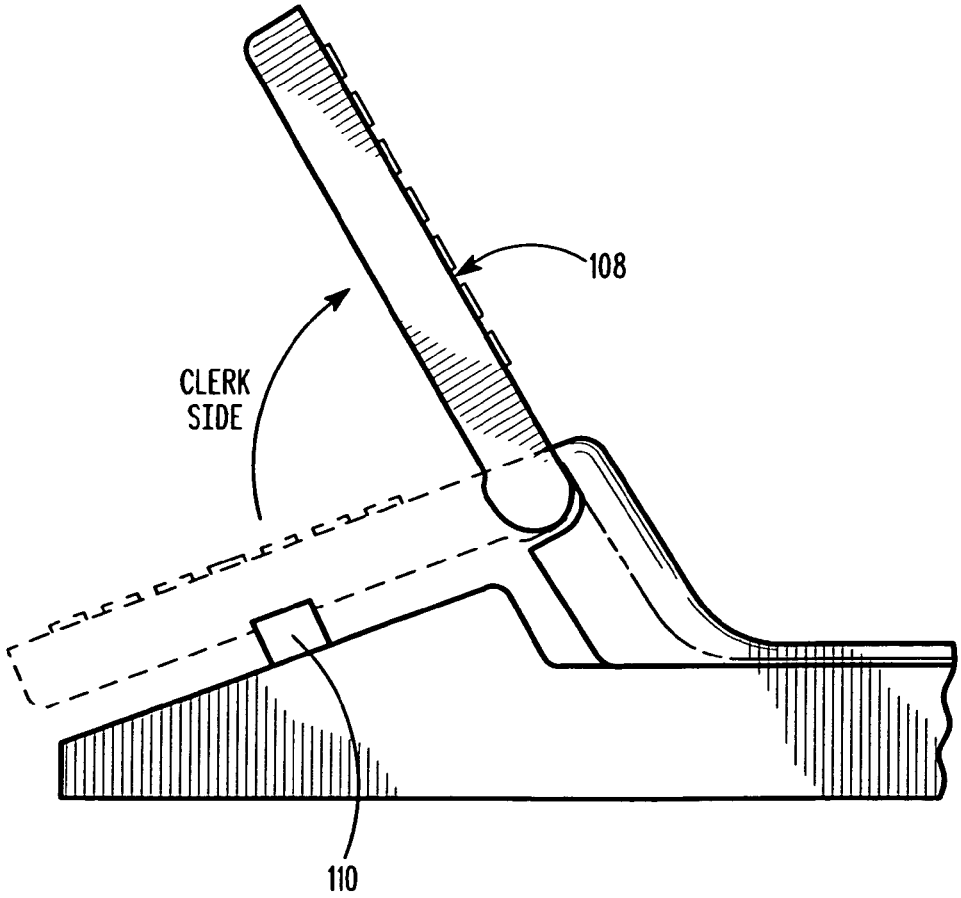
FIG. 9 is a broken-away, side view of the detail of the terminal of FIG. 3 in the self-service mode of operation.

In accordance with one aspect of this invention, a convertible checkout terminal 100, as depicted in FIGS. 3-7, includes a housing 102 having a main window 104 and a data capture device, e.g., the above-described plurality of imaging readers, for capturing through the main window 104 data associated with products to be checked out at the terminal 100. A customer interface 106 is supported by the housing 102, and is operative for enabling a customer to interact with the terminal 100 in a self-service mode of operation, as depicted in FIG. 5. A clerk interface 108 is also supported by the housing 102, and is operative for enabling a clerk to interact with the terminal 100 in the full-service mode of operation, as depicted in FIG. 4. A mode selector 110, as depicted in FIGS. 8-9, is operative for selecting either the self-service mode in which the customer interface 106 is operational, or the full-service mode in which the clerk interface 108 is operational. The terminal 100 of this invention is relatively inexpensive to install, and the interfaces 106, 108 are simple to operate, thereby maximizing their utilization. The terminal 100 is readily and rapidly convertible between full-service and self-service.

In a preferred embodiment, the housing 102 is supported by a support surface 112, such as a countertop formed with a recess 114 (see FIG. 3), and the housing 102 has a base portion 116 received in the recess 114. Such countertops are routinely available in retail stores. The main window 104 is located in a generally horizontal plane, and the housing 102 has another window, preferably a pair of side windows 118, 120, each located in a generally upright plane that intersects the generally horizontal plane. The housing 102 has a pair of opposite end regions 122, 124 and a central region 126 between the end regions 122, 124. The central region 126 lies in the generally horizontal plane, and the end regions 122, 124 have tilted portions that lie in inclined planes that intersect the horizontal plane. Preferably, the main window 104 is located in the central region 126, and is substantially flush with the upper surface of the countertop 116. The side windows 118, 120 are located in the end regions 122, 124 above the countertop 116 and mutually face each other across a reading zone 128, shown by stippling in FIG. 6, through which the products bearing the indicia to be read are passed. One or more of the aforementioned imaging readers 30 can be positioned behind each window 104, 118, 120. Alternately, rather than using imaging readers, laser scan generators, as described above, could be employed to replace one, some, or all of the imaging readers.

The customer interface 106 has a first interactive screen, e.g., a display and/or touch screen, located at the end region 122. The customer has ready manual access to the touch screen 106 to process a transaction, and can readily see visual information on the display to process the transaction, without assistance from a clerk. The clerk interface 108 has a second interactive screen, e.g. a display and/or touch screen, located at the other end region 124. The clerk has ready manual access to the touch screen 108 to process a transaction, and can readily see visual information on the display to process the transaction on behalf of the customer.

A receipt printer 128 may be located at either end region 122, 124 to print a receipt for the customer. As illustrated, the printer 128 is located at the end region 122. It is currently preferred if the printer 128 is located at the end region 124 so that the clerk can readily replace a supply roll of receipts. It is further preferred if a slot through which the receipts are dispensed is positioned to face a central area of the terminal 100, thereby preventing the receipts from falling off the countertop and landing on the floor. A keypad 130 is preferably located at the other end region 124 to enable manual entry of information by the clerk. As best shown in FIGS. 8-9, the second interactive screen 108 is mounted at the other end region 124 for movement, e.g., pivoting movement, between a raised position (FIG. 9) in which the second interactive screen 108 faces and interacts with the customer, and a lowered position (FIG. 8) in which the second interactive screen 108 faces and interacts with the clerk. Thus, in the self-service mode, both screens 106, 108 face and interact with the customer, whereas, in the full-service mode, only screen 106 faces and interacts with the customer. Screen 108 could, for example, provide message prompts to guide the customer through the transaction, while screen 106 could be used for manual entry of information.

The mode selector 110 is preferably an actuatable switch, e.g., a pressure, magnetic, or optical switch, actuated by the second interactive screen 108 when moved between the raised and lowered positions. The controller 44 is operatively connected to the switch 110, for controlling operation of the self-service mode in the raised position, and for controlling operation of the full-service mode in the lowered position. For example, the controller 44 insures that any alphanumeric information is presented in the correct orientation in each position of the screen 108. Thus, by simply moving the second interactive screen 108, the terminal 100 is rapidly and easily converted.

Figure 10:
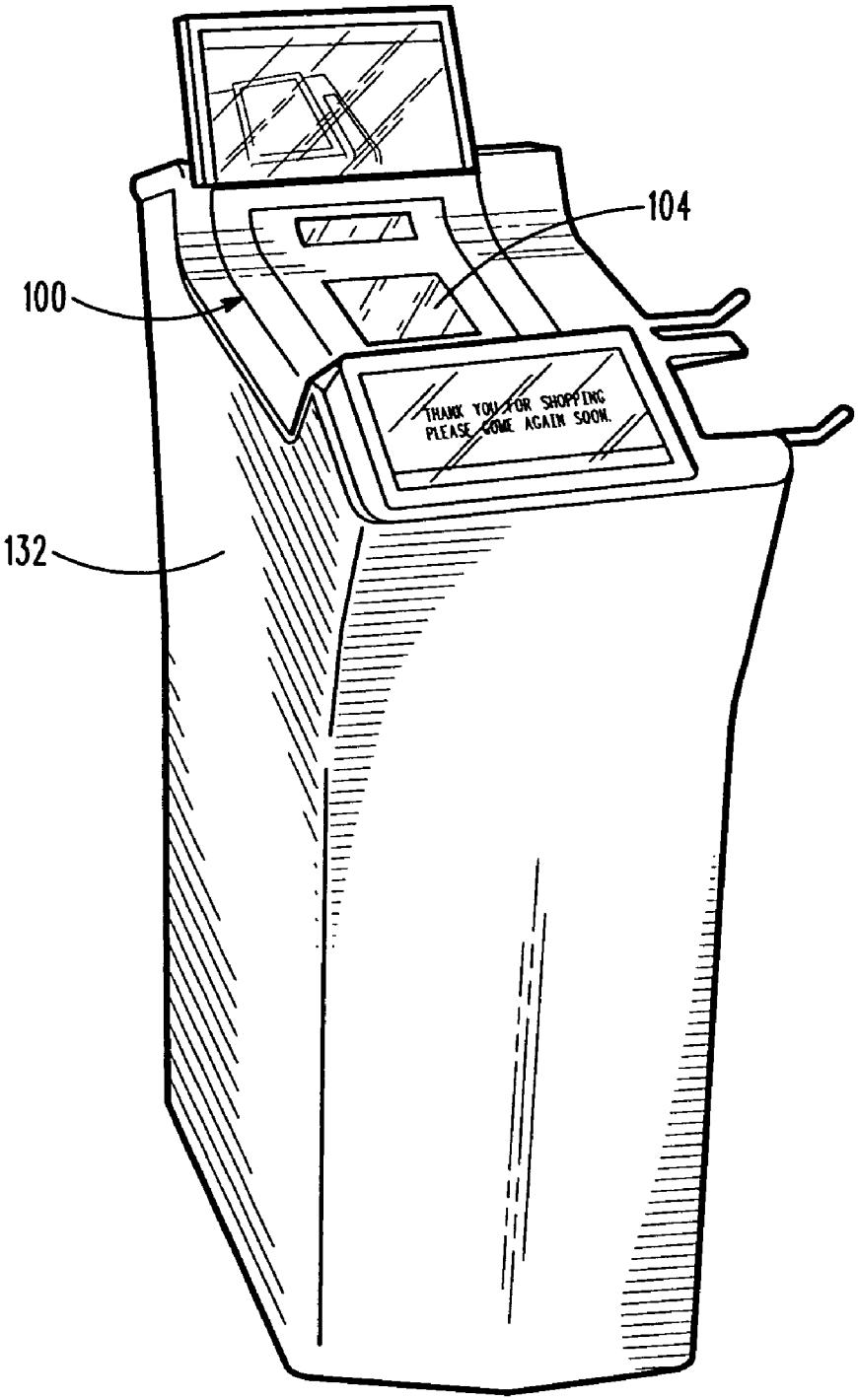
FIG. 10 is a perspective view of another mobile embodiment of a terminal.

The terminal 100 depicted in FIG. 10 is identical to that described above, except that the support surface is not an elongated countertop, but instead, is a pedestal 132 that can be readily moved from place to place to constitute a mobile terminal.

It will be understood that each of the elements described above, or two or more together, also may find a useful application in other types of constructions differing from the types described above.

While the invention has been illustrated and described as embodied in a convertible checkout terminal and method of converting between self-service and full-service modes of operation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. A convertible checkout terminal, comprising:

a housing having a window and a data capture device for capturing through the window data associated with products to be checked out at the terminal, and wherein the housing has a pair of opposite end regions and a central region between the end regions, and wherein the central region lies in a generally horizontal plane, and wherein the window is located in the central region;

a customer interface supported by the housing, for enabling a customer to interact with the terminal in a self-service mode of operation, and wherein the customer interface has a first interactive screen located at one of the end regions;

a clerk interface supported by the housing, for enabling a clerk to interact with the terminal in a full-service mode of operation, and wherein the clerk interface has a second interactive screen located at the other of the end regions, and the second interactive screen is mounted at said other end region for movement between a raised position in which the second interactive screen faces and interacts with the customer, and a lowered position in which the second interactive screen faces and interacts with the clerk; and a mode selector for selecting one of the self-service mode in which the customer interface is operational and the full-service mode in which the clerk interface is operational.

2. The terminal of claim 1, and a support surface on which the housing is supported.

3. The terminal of claim 2, wherein the support surface is a countertop having a recess, and wherein the housing has a base portion received in the recess.

4. The terminal of claim 1, wherein the window is located in a generally horizontal plane, and wherein the housing has another window located in a generally upright plane that intersects the generally horizontal plane.

5. The terminal of claim 4, wherein the data is indicia on the products, and wherein the data capture device includes an electro-optical reader for electro-optically reading the indicia.

6. The terminal of claim 5, wherein the reader includes a plurality of solid-state imagers for capturing light from the indicia through the windows along different fields of view.

7. The terminal of claim 1, and a receipt printer located at one of the end regions, and a keypad located at one of the end regions.

8. The terminal of claim 1, wherein the mode selector is an actuatable switch actuated by the second interactive screen when moved between said positions; and a controller operatively connected to the switch, for controlling operation of the self-service mode in the raised position, and for controlling operation of the full-service mode in the lowered position.

9. The terminal of claim 1, wherein the end regions have tilted portions that lie in inclined planes that intersect the horizontal plane.

10. The terminal of claim 9, wherein the housing has a pair of side windows located in the end regions and mutually facing each other.

11. A method of converting a checkout terminal between a self-service mode and a full-service mode of operation, comprising the steps of:

configuring a housing with a window and a data capture device for capturing through the window data associated with products to be checked out at the terminal, and configuring the housing with a pair of opposite end regions and a central region between the end regions, and configuring the central region to lie in a generally horizontal plane, and locating the window in the central region;

enabling a customer to interact with the terminal in the self-service mode of operation with a customer interface supported by the housing, and configuring the customer interface with a first interactive screen located at one of the end regions;

enabling a clerk to interact with the terminal in the full-service mode of operation with a clerk interface supported by the housing, and configuring the clerk interface with a second interactive screen located at the other of the end regions, and mounting the second interactive screen at said other end region for movement between a raised position in which the second interactive screen faces and interacts with the customer, and a lowered position in which the second interactive screen faces and interacts with the clerk; and selecting one of the self-service mode in which the customer interface is operational and the full-service mode in which the clerk interface is operational.

12. The method of claim 11, and supporting the housing on a support surface.

13. The method of claim 12, and forming the support surface with a recess, and mounting a base portion of the housing in the recess.

14. The method of claim 11, and locating the window in a generally horizontal plane, and configuring the housing with another window located in a generally upright plane that intersects the generally horizontal plane.

15. The method of claim 14, and configuring the data as indicia on the products, and configuring the data capture device as an electro-optical reader for electro-optically reading the indicia.

16. The method of claim 15, and capturing light from the indicia through the windows along different fields of view with a plurality of solid-state imagers.

17. The method of claim 11, and locating a receipt printer at one of the end regions, and locating a keypad at one of the end regions.

18. The method of claim 11, wherein the selecting step is performed by moving the second interactive screen between said positions; and controlling operation of the self-service mode in the raised position, and controlling operation of the full-service mode in the lowered position.

19. The method of claim 11, and configuring the end regions with tilted portions that lie in inclined planes that intersect the horizontal plane.

20. The method of claim 19, and configuring the housing with a pair of side windows located in the end regions and mutually facing each other.

* * * * *